US007004628B2

(12) United States Patent
Morgan

(10) Patent No.: US 7,004,628 B2
(45) Date of Patent: Feb. 28, 2006

(54) BAG TOPPER DEVICE

(75) Inventor: James W. Morgan, Walton, KY (US)

(73) Assignee: Duro Designer Company, Inc., Walton, KY (US)

( * ) Notice: Subject to any disclaimer, the term of this patent is extended or adjusted under 35 U.S.C. 154(b) by 0 days.

(21) Appl. No.: 10/660,316

(22) Filed: Sep. 11, 2003

(65) Prior Publication Data

US 2005/0070413 A1 Mar. 31, 2005

(51) Int. Cl.
*B65D 33/06* (2006.01)
*B65D 33/16* (2006.01)

(52) U.S. Cl. ..... 383/6; 383/78; 383/80

(58) Field of Classification Search ..... 383/80, 383/6, 78
See application file for complete search history.

(56) References Cited

U.S. PATENT DOCUMENTS

| | | | | |
|---|---|---|---|---|
| 1,355,353 | A | | 10/1920 | Pease |
| 2,143,957 | A | | 1/1939 | Petter |
| 2,469,536 | A | | 5/1949 | Winnesett |
| 2,650,016 | A | | 8/1953 | McMillan |
| 2,992,768 | A | | 7/1961 | Gatward |
| 3,006,532 | A | * | 10/1961 | Fine ..... 383/6 |
| 3,040,633 | A | | 6/1962 | Davis |
| 3,301,453 | A | * | 1/1967 | Stewart ..... 294/152 |
| 3,349,992 | A | * | 10/1967 | Skinner ..... 150/154 |
| 3,416,720 | A | | 12/1968 | Kleinhaut |
| 3,605,570 | A | | 9/1971 | Goodwin |
| 3,611,883 | A | | 10/1971 | Grob |
| 3,772,968 | A | | 11/1973 | Ruda |
| 4,018,142 | A | | 4/1977 | Canno |
| 4,210,068 | A | | 7/1980 | Baker |
| 4,498,192 | A | | 2/1985 | Becker et al. |
| 4,510,620 | A | | 4/1985 | Langen |
| 4,877,337 | A | | 10/1989 | Wood |
| 4,930,903 | A | * | 6/1990 | Mahoney ..... 383/6 |
| 5,356,221 | A | | 10/1994 | Achelpohl |
| 5,401,102 | A | | 3/1995 | Faltynek et al. |
| 5,458,556 | A | | 10/1995 | Hlubik |
| 6,171,166 | B1 | * | 1/2001 | Oquita ..... 446/5 |

* cited by examiner

*Primary Examiner*—Jes F. Pascua
(74) *Attorney, Agent, or Firm*—Donald E. Hasse; Hasse & Nesbitt LLC; Bobby D. Scearce

(57) ABSTRACT

A product carrying and storage device that comprises a bag with handles and a bag topper device with handle openings in which contents are placed into the bag and the topper device is then guided onto the handles of the bag to protect and insulate the interior contents.

9 Claims, 4 Drawing Sheets

BAG TOPPER DEVICE

FIELD OF INVENTION

This invention relates generally to the field of product packaging materials, more specifically, to a bag utilizing a bag top apparatus.

BACKGROUND OF THE INVENTION

Packaging materials are obviously used in a number of industries to deliver products to end consumers. In many of these industries, bags are used to enclose the product and permit easy transport by the consumer. Bags are a popular choice since they can be made from a variety of materials (e.g. paper, plastic, vinyl, etc.) and are relatively inexpensive. Bags can also be easily designed to accommodate a particular purpose, such as a shopping bag, lunch bag, heavy duty tote bag, etc. Boxes are popular for their structural rigidity and scalability, however, they are frequently bulky and more expensive than other materials.

Bags are often used to transport food products and/or items that are delicate. For food items, the top of the bag is typically rolled down to keep the food inside somewhat insulated from the external atmosphere. This results in reduced available volume for the food products and can also result in compression of the food items. For delicate items, bags are typically made with greater thicknesses and reinforced panels to increase the structural integrity of the bag; however, the bag still typically has a relatively weak upper portion.

Within the food product field, bags have been fabricated to increase the structural rigidity and provide atmospheric protection with using the foregoing methods. In U.S. Pat. No. 4,877,337 by Wood, an approach is disclosed in which a plastic top cover is thermosealed to fairly standard plastic bag thereby sealing the contents and providing structural reinforcement around the top portion of the bag. However, this approach requires special assembly equipment, creates a permanent seal and provides only limited structural support. Another approach for providing an enclosed top with structural reinforcement is shown in U.S. Pat. No. 4,018,142 by Canno. In the '142 patent, the bag top is folded similar to a box and a handle is drawn through a slot opening in the top. While this approach provides certain advantages, it provides the user with only a single handle, creates a taller bag into which the items must be raised farther prior to placement in the bag, requires scoring of the bag top to enable easy assembly, requires multiple folding steps in its assembly and creates a top that cannot easily be unfolded or lifted to permit quick access to the bag interior.

Boxes have been used as the material of choice for certain relatively delicate food items, such as doughnuts. The boxes are shipped flat to their end destinations and are usually assembled individually prior to placing product inside of the box. This process is inefficient as it requires assembly of the box prior to taking a customer's order and it uses a more expensive box instead of a less expensive bag. Also, the box is not equipped with handles for convenient transport.

Accordingly, as mentioned, the existing bags and boxes intended for holding products include significant limitations. As a result, significant improvement can still be made relative to creating a less expensive and more convenient product holder.

SUMMARY OF THE INVENTION

The present invention is intended to provide an improved product holder that is less expensive, easier to assemble and use, and has increased structural integrity to protect its contents as compared with existing holders.

The product holder is generally comprised of a bag with opposing handles adjacent to the bag opening and a bag topper that fits over the bag opening. The bag topper is formed with a substantially flat top and sides that extend downward to fit over the sides of the bag. The topper has slits in at least two sides that fit over the handles and hold the topper in place. In a preferred embodiment, the bag is a foldable rectangular paper bag and the topper is a foldable cardboard topper. This permits shipping the toppers as flat pieces while enabling easy assembly. In the preferred embodiment the bag is made from 57# Kraft paper with Kraft paper twisted handles and the topper is eighteen point bending chip board. If desired, graphics can be printed on the bag and/or topper.

One advantage of the present invention is that the bag topper provides increased structural rigidity for the bag. Another advantage is that the bag and topper is less expensive to manufacture. Another advantage of the invention is that the topper helps protects the contents against the exterior environment, including insulating hot or cold products. Another advantage is that products can be easily inserted into the bag container prior to placing the topper on the bag, and the top can easily be removed to insert or remove products in the bag. Another advantage of the invention is that the topper can be removed and used as a tray for the contents. Another advantage is that the product provides better graphic surfaces for advertising than other alternatives such as boxes. Another advantage is that the bag and topper can be manufactured from recycled materials certified for food contact. Another advantage is that the bag and topper generates waste that is more easily degradable than alternative materials such as plastic or wax coated papers.

DETAILED DESCRIPTION

Figure 1B:
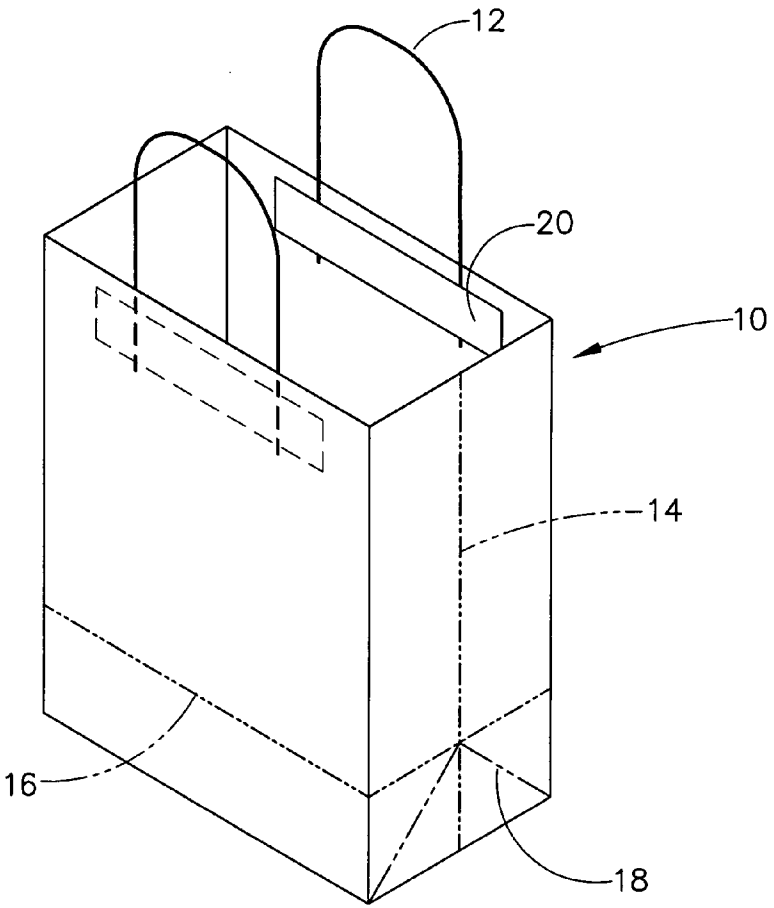
FIGS. 1A and 1B are folded and expanded perspective views of the bag portion of one embodiment of the present invention.
Figure 1A:
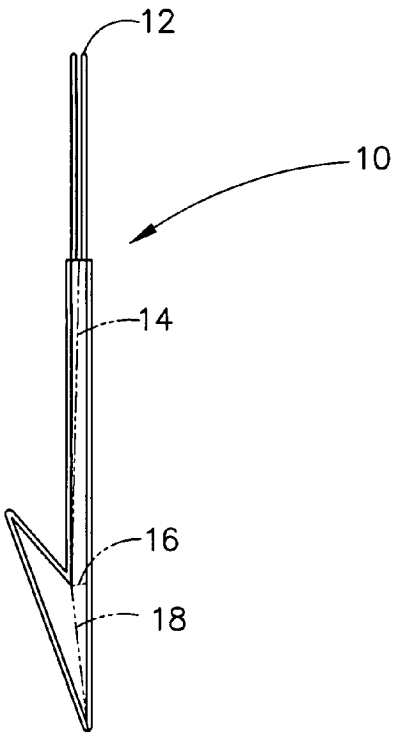

FIGS. 1A and 1B illustrate one embodiment of the bag 10 portion of the bag holder. The bag 10 is folded along a side fold 14, a base fold 16 and bottom folds 18 to permit the bag 10 to be folded flat as shown in FIG. 1A. The bag 10 also has handles 12 which are attached to the inside of opposing sides of the bag by sandwiching the handles 12 between a paper strip 20 and the inside of bag 10.

Figure 2B:
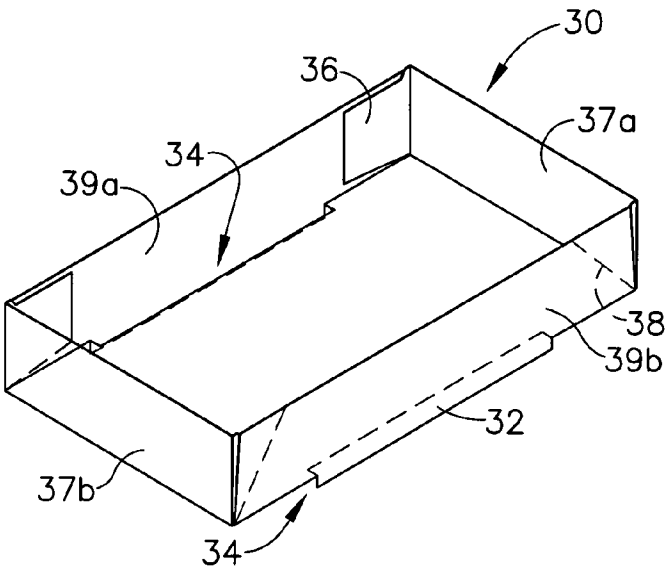
FIGS. 2A and 2B are folded and expanded perspective view of the bag topper portion of one embodiment of the present invention.
Figure 2A:
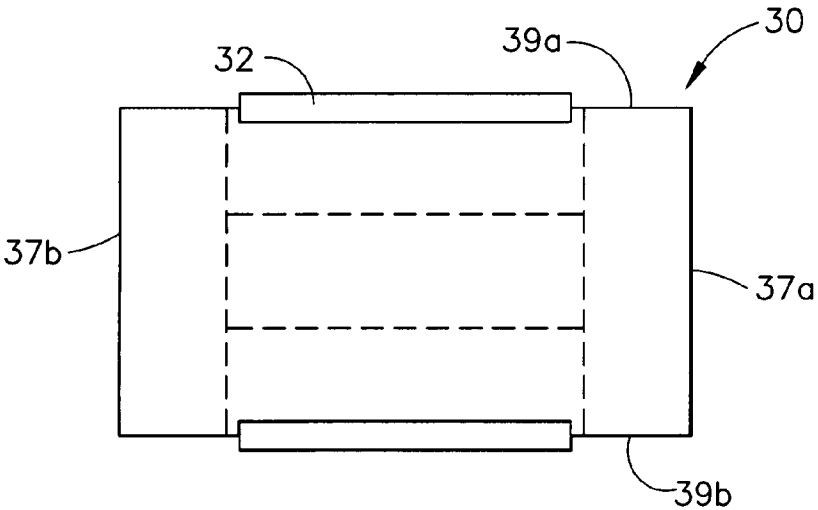

The bag 10 topping device is illustrated in FIGS. 2A and 2B. In FIG. 2A the topper 30 is folded into a generally rectangular shape with minor guide flaps 32 projecting from the opposing handle sides 39*a* and 39*b*. In FIG. 2B the topper 30 is unfolded further revealing the handle openings 34 in the opposing handle sides 39*a* and 39*b* and the end flaps 36 that connect the opposing sides 37*a* and 37*b* to the opposing handle sides 39*a* and 39*b*. Unfolding also reveals the collapsing folds 38 that permit the topper 30 to be folded flat as shown in FIG. 2A.

Figure 3:
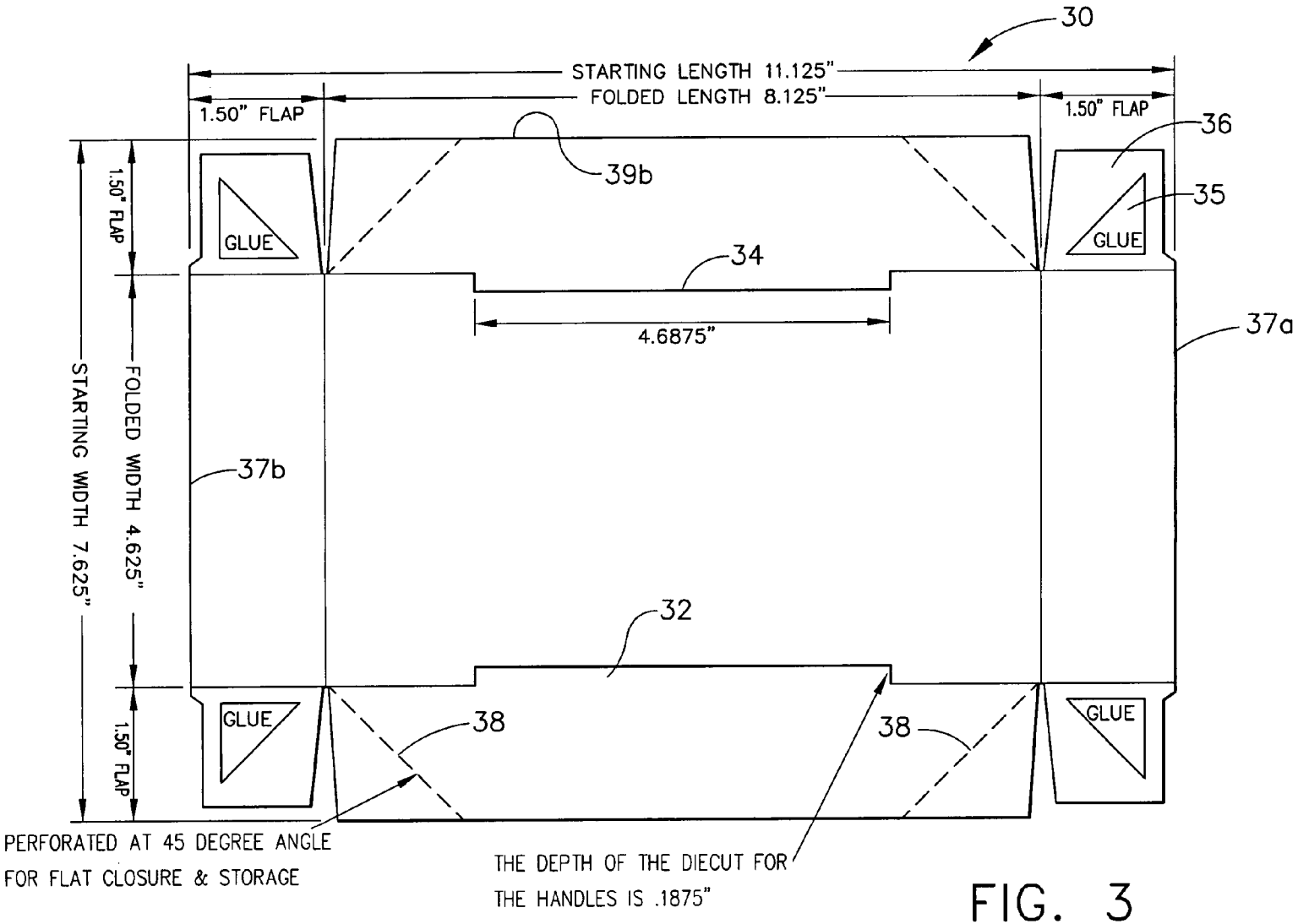
FIG. 3 is a bottom template view of the bag topper portion of the present invention shown in FIGS. 2A and 2B.

FIG. 3 further illustrates the topper 30 in template form. The template shows the attachment points 35 which are attached to the inside portion of the opposing handle sides 39*a* and 39*b* to connect them to the opposing sides 37*a* and 37*b*. Such attachment points 35 can be attached by a variety of means, including glue, staples, rivets, etc. The template in FIG. 3 also illustrates the area to be die cut along the common area designating the guide flap 32 and handle opening 34.

Figure 4C:
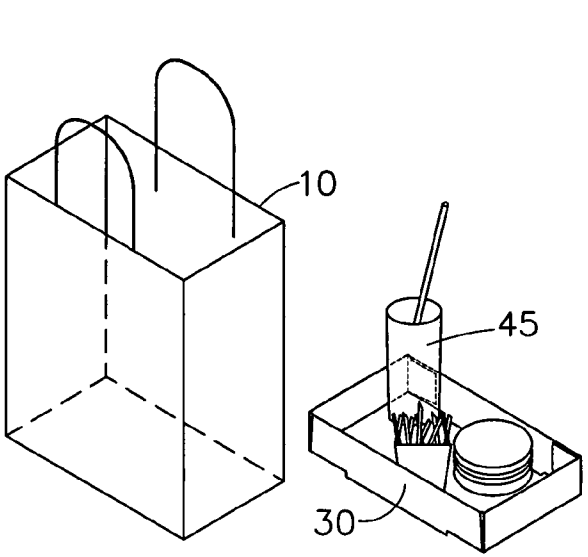
FIGS. 4A, 4B and 4C are perspective views of the bag and topper portions of the present invention separated, combined and being used.
Figure 4B:
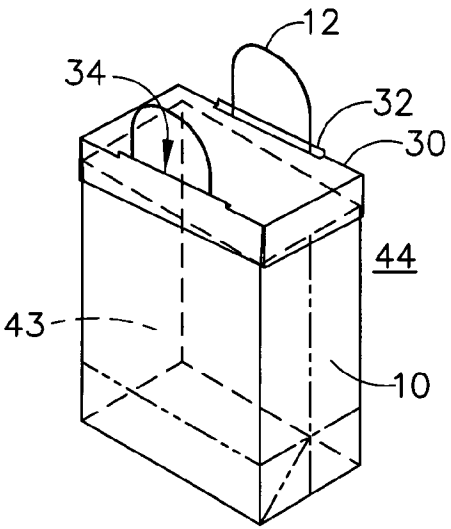
Figure 4A:
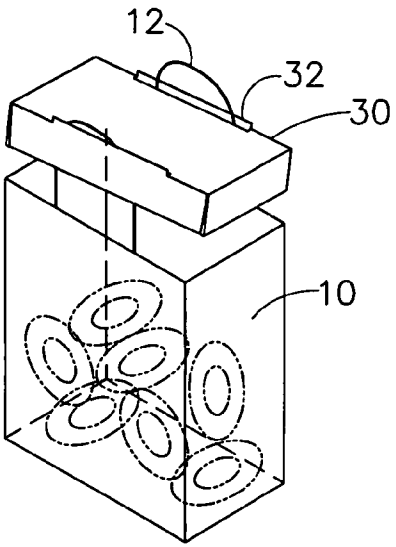

FIGS. 4A, 4B and 4C illustrate the bag 10 and topper 30 in use. The handles 12 of the bag 10 are pulled through the handle openings 34 of the topper 30 and onto the top of the bag 10 as shown in FIGS. 4A and 4B. The guide flaps 32 assist in guiding and holding the handles 12 in place. Upon placement of the topper 30 onto the bag 10 the interior environment 43 of the bag 10 is protected from the exterior atmosphere 44. The topper 30 can then be removed from the bag 10 and used as a tray for food 45 as shown in FIG. 4C.

The preceding description of the invention has shown and described certain embodiments thereof; however, it is intended by way of illustration and example only and not by way of limitation. Those skilled in the art should understand that various changes, omissions and additions may be made to the invention without departing from the spirit and scope of the invention.

I claim:

1. A product carrying and storage device comprising:

a) a bag having a substantially rectangularly shaped opening at a top portion thereof and first and second handles attached to said bag adjacent to said opening at respective first and second sides of said opening; and b) a bag topper having a bottom panel and four side panels defining a substantially rectangularly shaped opening sized to receive said top portion of said bag and thereby substantially close said opening of said bag in an assembled condition of said bag and topper, said topper having first and second slotted handle openings along at least two sides of said bottom panel defining corresponding first and second elongated guide flaps projection from respective side panels adjacent respective said first and second slotted handle openings for receiving respective said first and second handles in said assembled condition.

2. The device described in claim 1 wherein said bag has front and rear panel members and a pair of gusseted side panel members connecting said front and rear panel members and a bottom panel member connected to said front and rear panel members and said side panel members, said side panel members being foldable to a substantially flat folded storage condition for said front and said rear panel members and said bottom panel member.

3. The device described in claim 2 wherein said bag is made from paper and said topper is made from cardboard.

4. The device described in claim 2 wherein said bag has two handles and said topper has two handle openings.

5. The device described in claim 2 wherein said topper is formed from a single sheet of material having marginal portions around the perimeter thereof being foldable to form said side panels and wherein each of two said side panels includes two flaps that are foldable and attachable to respective adjacent said side panels to define said rectangularly shaped opening of said topper.

6. The device described in claim 5 wherein said first and second slotted handle openings are defined in said single sheet of material by partial cuts along at least two sides of said bottom member.

7. A method of forming and using a product carrying and storage device comprising the steps of:

a) providing a bag having a substantially rectangularly shaped opening at a top portion thereof and first and second handles attached to said bag adjacent to said opening at respective first and second sides of said opening;

b) providing a bag topper having a bottom panel and four side panels defining a substantially rectangularly shaped opening sized to receive said top portion of said bag and thereby substantially close said opening of said bag in an assembled condition of said bag and topper, said topper having first and second slotted handle openings along at least two sides of said bottom panel defining corresponding first and second elongated guide flaps projecting from respective side panels and adjacent respective said first and second slotted handle openings for receiving respective said first and second handles in said assembled condition; and c) inserting said first and second handles through respective said handle openings of said topper to define an assembled conditions of said topper and said bag.

8. The method described in claim 7 wherein prior to said inserting step the method further comprises the step of placing a product into said bag.

9. The method described in claim 8 wherein said method further comprises the steps of:

a) removing said topper from said bag by pulling said topper off of said handles; and b) inverting said topper to define a tray having a bottom defined by said bottom panel; and c) using said topper as a tray for said product in said bag.

* * * * *